United States Patent [19]

Benitez

[11] Patent Number: 4,799,528

[45] Date of Patent: Jan. 24, 1989

[54] CLOSURE DEVICE

[76] Inventor: Richard Benitez, Apt. B, 9209 Connechusset Rd., Tampa, Fla. 33617

[21] Appl. No.: 104,429

[22] Filed: Oct. 5, 1987

[51] Int. Cl.[4] ..... E05D 15/26

[52] U.S. Cl. ..... 160/199; 160/206

[58] Field of Search ..... 160/199, 206, 213, 273.1, 160/196.1, 130

[56] References Cited

U.S. PATENT DOCUMENTS

| | | | |
|---|---|---|---|
| 484,957 | 10/1892 | Gillian | 160/196.1 X |
| 1,508,968 | 9/1924 | Green | 160/199 X |
| 3,798,839 | 3/1974 | Kaufman | 160/199 X |
| 4,359,080 | 11/1982 | Brydolf | 160/199 |

*Primary Examiner*—Ramon S. Britts
*Assistant Examiner*—Blair Johnson
*Attorney, Agent, or Firm*—A. W. Fisher, III

[57] ABSTRACT

A closure device comprising at least one set of panels movable between an extended and retracted position to selectively secure a portal such as a door or window when the panels are in the extended position, the set of panels comprises at least two panel members hingedly attached to each other to permit selective extension and retraction of the set of panels on an upper and lower track, each panel member comprising a pair of elongated panel elements held in substantially parallel spaced relation relative to each by an upper and lower plate coupled to opposite ends thereof, an upper and lower attachment device is coupled to the mid-portion of upper and lower plate respectively to operatively mount the set of panels between the upper and lower track and a lock device movable between a first and second position disposed to engage the panels when in the first position to secure the panels in the extended position to prevent entry through the portal and to disengage the panels when in the second position to permit movement of the panels to the retracted position to provide entry through the portal.

14 Claims, 2 Drawing Sheets

CLOSURE DEVICE

BACKGROUND OF THE INVENTION

1. Field of the Invention

A closure device comprising at least one set of panels movable between an extended and a retracted position to selectively secure or close a portal such as a door or window when the set of panels are in the extended position.

2. Description of the Prior Art

Various security screens and grates are known in the art. These security devices are commonly heavy constructed such that opening or closing involves movement of a substantial weight. Often these devices are constructed of parallel linkages with angularly movable links that connect vertical bars in general traversing a plurality of such bars. Typical of such parallel linkage types is disclosed in U.S. Pat. No. 917,713. Other foldable structures use vertically movable bars. Such vertical movement may have unsecured areas above and below the screening. This type of device is shown in U.S. Pat. No. 1,721,998.

U.S. Pat. Nos. 4,006,768 and 2,754,902 show collapsible panels serving as security screens each having a roller attachment member disposed within a channel.

U.S. Pat. Nos. 1,581,854 and 931,421 disclose at least one set of hingedly attached panels permitting retraction by movement in the horizontal plane while the pair of hingedly attached members collapse onto each other. Further, it should be noted that U.S. Pat. No. 1,581,854 discloses a pair of wheels operatively disposed within a tract which is attached to the outer hingedly attached panel member.

Additional examples of the prior art are shown in U.S. Pat. Nos. 83,053, 145,773, 284,117, 560,937, 570,713, 958,481, 1,471,477, 1,501,545, 1,532,769, 1,715,208, 1,735,415, 1,750,989, 1,946,381, 1,989,392, 2,422,840 2,479,123, 2,687,170, 2,728,388, 2,754,902, 3,297,077, 3,670,797, 3,720,255, 3,743,001, and 3,942,576.

SUMMARY OF THE INVENTION

The present invention relates to a closure device to selectively secure or close a portal such as a door or window.

The closure device comprises one or more sets of panels movable between an extended and retracted position on an upper and lower track.

Each set of panels comprises at least two panel members hingedly attached to each other to permit the extension or retraction of the set of panels.

The upper and lower tracks include a channel and rail slot formed therein to receive a portion of an upper and lower attachment device.

The upper attachment device comprises an interconnecting element extending through the rail slot having a cross-element disposed in the channel attached to the outer end thereof coupled to the panel member. A pair of roller bearings is affixed to the cross-element within the channel on opposite sides of the interconnecting element.

The lower attachment device comprises an interconnecting element extending through the rail slot having a cross-element disposed in the channel attached to the outer end thereof and an enlarged attachment element attached to the inner end thereof coupled to the panel member.

A lock means movable between a first and second position is disposed to engage the lower attachment device when in the first position to secure the panels in the extended position to prevent entry through the portal.

In use, the upper and lower tracks are secured to the wall adjacent the portal. To secure or close the portal, the two sets of panels are extended inwardly toward each other along the upper and lower tracks and secured in the extended position by the a lock means. In the closed or extended position, the panel members are disposed in coplanar relation relative to each other.

In the open or retracted position, the panel members of each set are disposed in side-by-side relation relative to each other.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
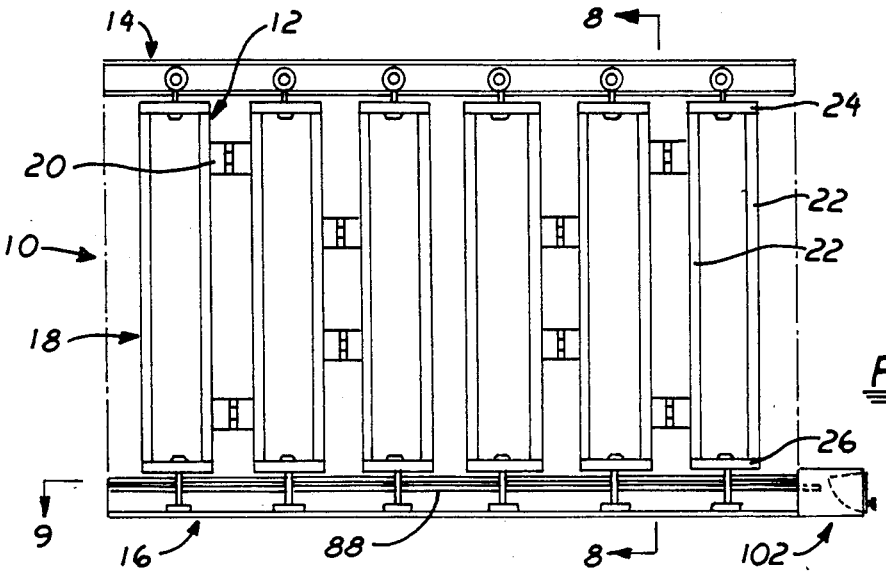
FIG. 1 is a front view of th closure device in the partially extended position.

As shown in FIG. 1, the present invention relates to a closure device generally indicated as 10 to selectively secure or close a portal such as a door or window.

The closure device 10 comprises one or more sets of panels each generally indicated as 12 movable between an extended and retracted position on an upper and lower track generally indicated as 14 nd 16 respectively disposed within the portal.

Each set of panels 12 comprises at least two panel members each generally indicated as 18 hingedly attached to each other by one or more hinges each indicated as 20 to permit the extension of retraction of the set of panels 12 as more fully described hereinafter. Each panel member 18 comprises a pair of elongated panel elements each indicated as 22 held in substantially parallel relation relative to each other by a substantially flat upper and lower plate indicated as 24 and 26 respectively coupled to opposite ends thereof.

Figure 3:
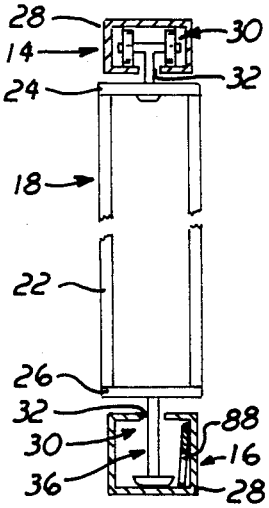
FIG. 3 is a cross-section end view of the closure device in the retracted position taken along line 3—3 of FIG. 2.
Figure 8:
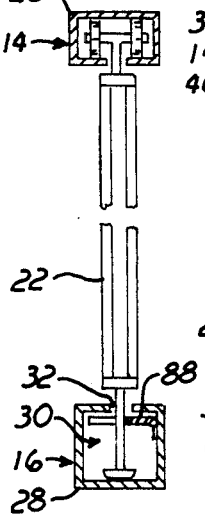
FIG. 8 is a cross-sectioned end view of the closure device in the extended position taken along line 8—8 of FIG. 1.

As shown in FIGS. 3 and 8, the upper and lower tracks 14 and 16 each comprises a substantially C-shaped rail 28 having a channel and rail slot 30 and 32 respectively formed therein to receive a portion of an upper and lower attachment device generally indicated as 34 and 36 respectively as more fully described hereinafter.

Figure 4:
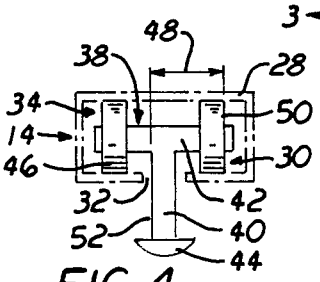
FIG. 4 is a detailed end view of the upper attachment device.

As shown in FIG. 4, the upper attachment device 34 includes a T-shaped member generally indicated as 38 comprising an interconnecting element 40 extending through the rail slot 32 having a cross-element 42 disposed in the channel 30 attached to the outer end thereof and an enlarged attachment element 44 attached to the inner end thereof coupled to the substantially flat upper plate 24. A pair of roller bearings each indicated as 46 is affixed to the cross-element 42 within the channel 30 on opposite sides of the interconnecting element 40 As shown in FIG. 4, the lateral distance 48 from the outside surface 50 of either roller bearing 46 to the corresponding opposite side 52 of the interconnecting element 40 is greater than the width of the rail slot 32 of the upper track 14.

Figure 5:
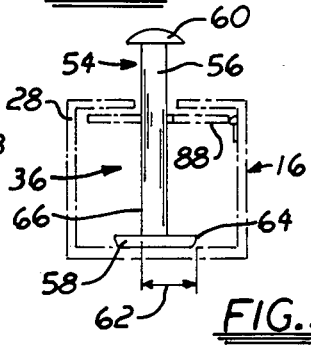
FIG. 5 is a detailed end view of the lower attachment device.

As shown in FIG. 5, the lower attachment device 36 includes a T-shaped member generally indicated as 54 comprising an interconnecting element 56 extending through the rail slot 32 having a cross-element 58 disposed in the channel 30 attached to the outer end thereof and an enlarged attachment element 60 attached to the inner end thereof coupled to the substantially flat lower plate 26. As shown in FIG. 5, the lateral distance 62 from the outer periphery 64 of the enlarged attachment element 60 to the corresponding opposite side 66 of the interconnecting element 56 is greater than the width of the rail slot 32 of the lower track 16.

Figure 6:
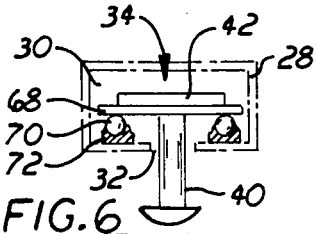
FIG. 6 is a detailed end view of an alternate embodiment of the upper attachment device.

FIG. 6 shows an alternate upper attachment device 34 comprising a slide element 68 attached to the upper portion of the interconnecting element 40 below the cross-element 42. The slide element 68 is disposed to slidably engage the upper surfaces of two substantially parallel rows of rollers 70 rotatably coupled to the substantially C-shaped rail 28 by a pair of corresponding mounting bases 72.

Figure 7:
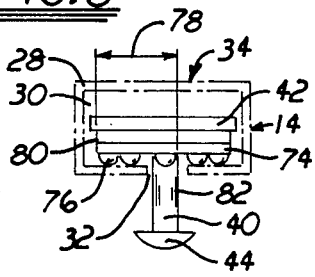
FIG. 7 is a detailed end view of another alternate embodiment of the upper attachment device.

FIG. 7 shows another alternate embodiment of the upper attachment device 34. More specifically, the upper attachment device 34 comprises a mounting plate 74 attached to the upper portion of the interconnecting element 40 below the cross-element 42. The mounting plate 74 includes a plurality of rollers each indicated as 76 rotatably mounted thereon disposed to engage the substantially C-shaped rail 28 on opposite sides of the rail slot 32. The lateral distance 78 from the outer periphery 80 of the mounting plate 74 to the corresponding opposite side 82 of the interconnecting element 40 is greater than the width of the rail slot 32 of the upper track 14.

Figure 9:
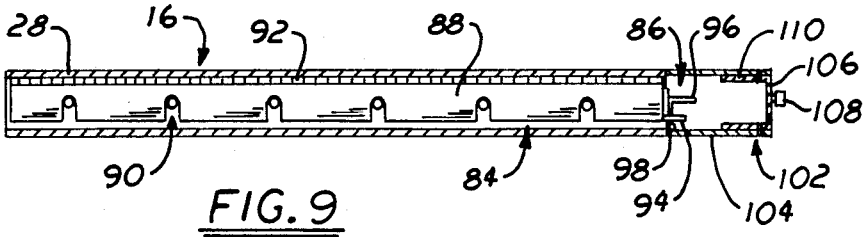
FIG. 9 is a top cross-sectional view taken along line 9—9 of FIG. 1.
Figure 10:
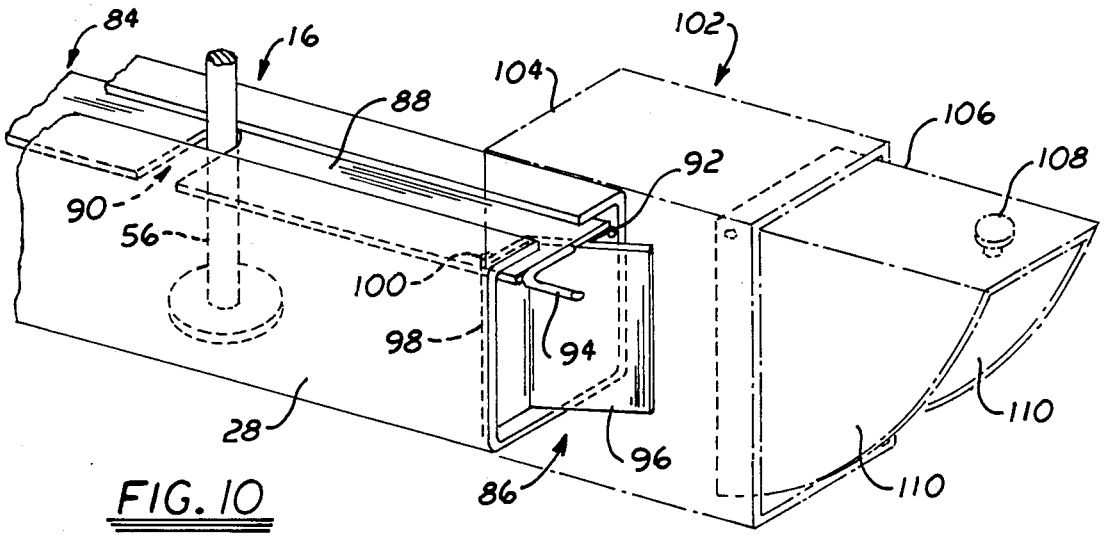
FIG. 10 is a perspective view of the lock means.

As best shown in FIGS. 9 and 10, a lock means comprising a lock member and retainer member generally indicated as 84 and 86 respectively is coupled to the lower track 16 device 36 to selectively secure the sets of panels 12 in the extended position as described more fully hereinafter. Specifically, the lock member 84 comprises a flat lock plate 88 having a plurality of lock slots each indicated as 90 corresponding to each interconnecting element 56 formed thereon. The flat lock plate 88 is pivotally coupled to the lower track 16 by a hinge 92 or other suitable means coupled to the lower track 16. A lock engagement element 94 is affixed to one end portion of the flat lock plate 88.

The retainer member 86 comprises a lock retainer member 96 rotatably coupled to the lower track 16 by a coupling member 98 extending through apertures 100 formed in the lower track 16.

Figure 11:
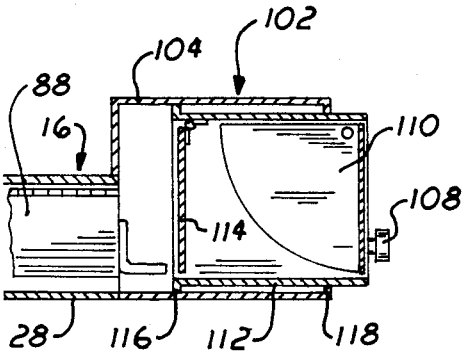
FIG. 11 is a cross-sectional side view of an alternate guard shield in the closed or retracted position.
Figure 12:
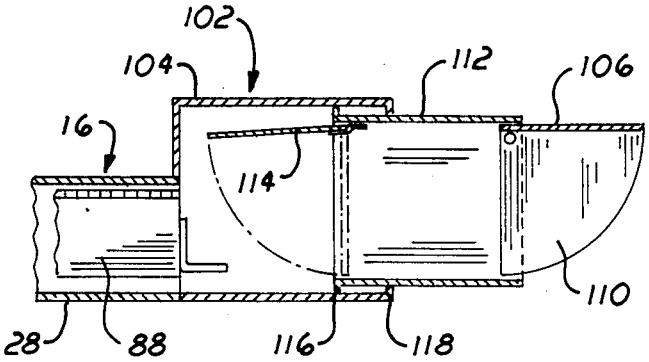
FIG. 12 is a cross-sectional side view of the alternate guard shield in the open or extended position.

The lock means further includes a guard shield or shroud generally indicated as 102. The guard shield or shroud 102 comprises a primary hollow housing 104 affixed to the lower track 16 to operatively house and enclose the lock engagement element 94 and lock retainer member 96. A housing door 106 including handle 108 affixed to the outer surface thereof is pivotably attached to the outer portion of the primary hollow housing 104. The housing door 106 includes a pair of side plates each indicated as 110. As shown in FIGS. 11 and 12, a secondary hollow housing 112 may be telescopingly disposed within the primary hollow housing 104 including a trap door 114 hingedly disposed in the inner portion thereof. The primary and secondary hollow housings 106 and 112 include a first and second pair of retainer flanges indicated as 116 and 118 respectively to limit the outward movement of the secondary hollow housing 112 relative to the primary hollow housing 104. When in the retracted position, the trap door 114 prevents a hand being moved through the guard shield or shroud 102 to activate or move the lock retainer member 96 as described more fully hereinafter.

In use the upper and lower tracks 14 and 16 are secured to the frame (not shown) of the portal. The outer panel members 18 are secured to opposite ends of the upper end and lower tracks 14 and 16.

To secure or close the portal, the two sets of panels 12 are extended inwardly toward each other along the upper and lower tracks 14 and 16. In the closed or extended position, the panel members 18 are disposed in coplanar relation relative to each other as shown in FIG. 1.

The flat lock plate 88 is then rotated to the horizontal position such that the interconnecting elements 56 of the lower attachment device 36 extend through the corresponding lock slot 90. The flat lock plate 88 is held in the horizontal or locking position by rotating the lock retainer member 96 beneath the lock engagement element 94. The guard shield or shroud 102 prevents access to the lock retainer member 96 from outside the portal to prevent unlocking of the closure device 10 due to the lateral separation between the outer end of the guard shield or shroud 102 and the lock retainer plate 96. To unlock the lock means, the housing door 106 is opened and an arm is inserted through the guard shield or shroud 102 to rotate the lock retainer member 96 out of engagement with the lock engagement element 94 permitting the flat lock plate 88 to pivot downwardly out of registry with the interconnecting elements 56 to permit the sets of panels 12 to be moved long the upper and lower tracks 14 and 16 to open the portal.

Figure 2:
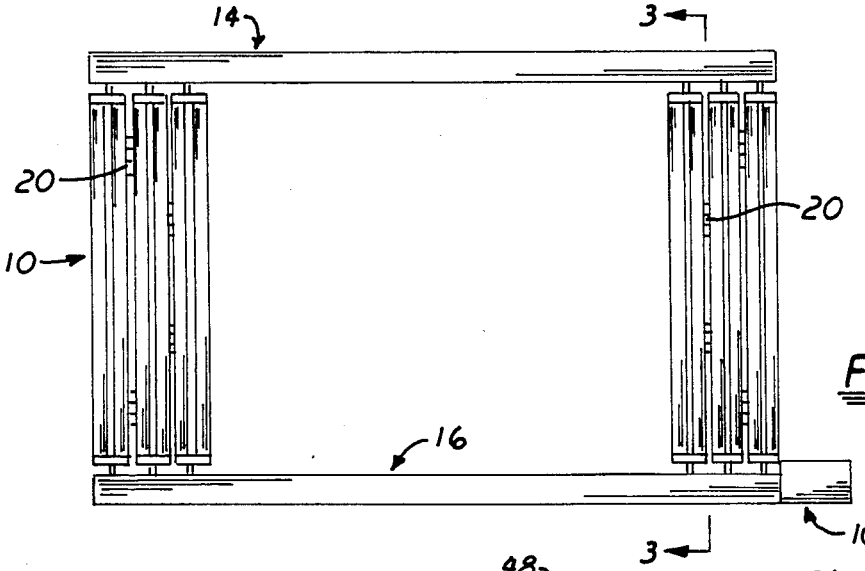
FIG. 2 is a front view of the closure device in the retracted position.

As shown in FIG. 2, in the open or retracted position the panel members 18 are disposed in side-by-said relation relative to each other.

It will thus be seen that the objects set forth above, and those made apparent from the preceding description are efficiently attained and since certain changes may be made in the above construction without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which as a matter of language, might be said to fall therebetween.

Now that the invention has been described,

What is claimed is:

1. A closure device comprising at least one set of panels movable between an extended and retracted position to selectively secure a portal such as a door or window when said set of panels is in the extended position, said set of panels comprises at least two panel members hingedly attached to each other to permit selective extension and retraction of said set of panels on an upper and lower track, each said panel member comprising a pair of elongated panel elements held in substantially parallel spaced relation relative to each by an upper and lower plate coupled to opposite ends thereof, an upper and lower attachment device is coupled to said upper and lower plate respectively to operatively mount said set of panels between said upper and lower track and a lock means including a lock plate movable between a first and second position pivotally coupled to said lower track having a plurality of lock slots formed therein corresponding to each said lower attachment device disposed to engage each said lower attachment device when in said first position to secure said set of panels in the extended position to prevent entry through the portal and to disengage said lower attachment device when in said second position to permit movement of said set of panels to the retracted position to permit entry through the portal and a retainer member disposed to selectively engage said lock plate to maintain said lock plate in said first position.

2. The enclosure device of claim 1 wherein said lock plate further includes a lock engagement element extending from one end portion thereof and said retainer member includes a lock retainer member rotatably coupled to said lower track to selectively engage said lock engagement element to retain said lock plate in said first position.

3. The enclosure device of claim 2 wherein said lock means further includes a guard shield affixed to said lower track to operatively house said lock engagement member and said lock retainer member to limit access thereto.

4. The closure device of claim 3 wherein said guard shield further including a secondary hollow housing telescopingly disposed within said primary hollow housing including a trap door hingedly disposed in a portion thereof such that when said secondary hollow housing is telescopingly received within said primary hollow housing, said trap door prevents access to said lock retainer member.

5. The closure device of claim 1 wherein said upper and lower track each comprises a C-shaped rail having a channel formed therein and a rail slot extending longitudinally substantially the length thereof to receive a portion of said upper and lower attachment device respectively.

6. The closure device of claim 5 wherein said upper attachment device comprises an interconnecting element extending through said rail slot of said upper track having a cross-element disposed in said channel on the upper portion thereof and an attachment on the lower portion thereof coupled to said upper plate.

7. The closure device of claim 6 wherein said upper attachment device further includes a pair of roller bearings affixed to said cross-element within said channel on opposite sides of said interconnecting element.

8. The closure device of claim 7 wherein the lateral distance from the outside surface of either roller bearing to the opposite respective side of said interconnecting element is greater than the width of said rail slot of said upper track.

9. The closure device of claim 5 wherein said lower attachment device comprises an interconnecting element extending through said rail slot of said lower track having a cross-element disposed in said channel on the lower portion thereof and an attached element attached to the upper portion

10. The closure element of claim 9 wherein the lateral distance from the outer periphery of said cross-element to the opposite respective side of said interconnecting element is greater than the width of said rail slot of said lower track.

11. The closure device of claim 6 wherein said upper attachment device comprises a slide element attached to the upper portion of said interconnecting element below said cross-element, said slide element disposed to slidably engage the upper surface of two substantially parallel rows of rollers rotatably coupled to said substantially rail by corresponding pair of mounting bases.

12. The enclosure device of claim 6 wherein said upper attachment device comprises a bearing surface attached to the upper portion of said interconnecting element below said cross member, said bearing surface having a plurality of rollers rotatably mounted thereon disposed to slidably engage said rail on opposite sides of said rail slot.

13. The closure element of claim 12 wherein the lateral distance from the outer periphery of said bearing surface to the opposite respective side of said interconnecting element is greater than the width of said rail said upper track.

14. The closure device of claim 3 wherein said guard shield comprises a primary hollow housing having a housing door affixed thereto, said housing door including a side plate formed on opposite sides thereof.

* * * * *